US007741929B2

(12) United States Patent
Hash

(10) Patent No.: US 7,741,929 B2
(45) Date of Patent: Jun. 22, 2010

(54) MINIATURE QUADRATURE HYBRID

(75) Inventor: Ronald J. Hash, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 194 days.

(21) Appl. No.: 12/189,240

(22) Filed: Aug. 11, 2008

(65) Prior Publication Data

US 2010/0033265 A1 Feb. 11, 2010

(51) Int. Cl.
*H01P 5/18* (2006.01)
*H01P 3/08* (2006.01)

(52) U.S. Cl. ..... 333/116; 333/238

(58) Field of Classification Search ..... 333/116, 333/109, 110, 111, 112, 115, 238
See application file for complete search history.

(56) References Cited

U.S. PATENT DOCUMENTS 5,767,753 A * 6/1998 Ruelke ..... 333/116

6,323,741 B1 * 11/2001 Kim ..... 333/116

* cited by examiner

*Primary Examiner*—Dean O Takaoka
(74) *Attorney, Agent, or Firm*—Fox Rothschild, LLP; Robert J. Sacco

(57) ABSTRACT

A radio frequency (RF) directional coupler (100) can include a first transmission line element (102) having a first end and a second end, and a second transmission line element (104) having a first end and a second end. The first and second transmission line elements (102, 104) can be disposed in a first plane, where at least a portion of said first and said second transmission line elements (102, 104) are adjacent along a path. The RF coupler (100) can also include a first series of conductive coupling elements (116) disposed along said path in a second plane parallel to the first plane and separated from said first and said second transmission line elements (102, 104) by a first dielectric element (114). The first and second plane can be separated by a pre-determined distance ($t_2$) to increase a capacitive coupling between the first and second transmission line elements (102, 104).

20 Claims, 6 Drawing Sheets

MINIATURE QUADRATURE HYBRID

STATEMENT REGARDING FEDERALLY SPONSORED RESEARCH OR DEVELOPMENT

This invention was made with government support. The government has certain rights in the invention.

BACKGROUND OF THE INVENTION

1. Statement of the Technical Field

The present invention is directed to the field of directional couplers, and more particularly, to directional couplers having a miniaturized design.

2. Description of the Related Art

Directional couplers are four-port circuits typically used for sampling of the input power for use in signal monitoring circuits. The sampled signal is typically measured to determine the power level, frequency, and/or signal shape (modulation) of the input signal. One typical directional coupler configuration is referred to as a hybrid coupler, a 3 dB coupler, a 3 dB hybrid coupler, a quadrature coupler, or a quadrature hybrid coupler, amongst other names. Regardless of how it is referred to, the quadrature hybrid coupler generally has the characteristics of dividing the input signal into two signals having equal powers and separated in phase by 90° when the four ports are properly terminated.

Typically, quadrature hybrid couplers are implemented by using two edge coupled transmission lines. However, planar circuit fabrication technologies, such as integrated circuit technologies, stripline technologies, and printed circuit board technologies, typically require a gap or spacing between the two coupled lines that is generally too small to be practically and reliably fabricated using conventional processes. Furthermore, the transmission lines typically used to provide proper coupling generally have large dimensions wide and long in order to achieve the impedance ranges typically used in radio frequency (RF) applications. One proposed solution has been the use of Lange couplers with two or more pairs of lines. However, even though Lange couplers alleviate the gap problem for planar processing technologies, the resulting size of Lange couplers is still problematic, as a quarter wavelength electrical length is still required for the coupler, resulting in couplers with a size typically exceeding that of any associated circuitry.

SUMMARY OF THE INVENTION

The invention concerns a radio frequency (RF) directional coupler. In a first embodiment of the present invention, the RF coupler can comprise a first transmission line element having a first end and a second end, a second transmission line element having a first end and a second end. The first and second transmission line elements can be disposed in a first plane, where at least a portion of the first and the second transmission line elements are adjacent along a path. The RF coupler can further comprise a first series of conductive coupling elements disposed along the path in a second plane parallel to the first plane and separated from the first and the second transmission line elements by a first dielectric element. The first and the second plane can be separated by a pre-determined distance to increase a capacitive coupling between the first and the second transmission line elements.

In a second embodiment of the present invention, an integrated circuit can be provided. The integrated circuit can include a substrate having a semiconducting surface, a plurality of circuit elements formed on the semiconducting surface, and a multilayer metal interconnect structure for connecting the circuit elements. The interconnect structure can include a first conductive element in a first metal layer of the interconnect structure, the first conductive element having a first end and a second end, and a second conductive element in the first metal layer, the second conductive element having a first end and a second end. In the interconnect structure, at least a portion of the first and the second conductive elements can be adjacent along a path. The interconnect structure can also include a first series of conductive coupling elements disposed along the path in a second metal layer of the interconnect structure, where the second metal layer is selected to position the first series of coupling elements a pre-determined distance from the first and the second conductive line elements to increase a capacitive coupling between the first and the second conductive elements.

DETAILED DESCRIPTION OF THE PREFERRED EMBODIMENTS

Figure 1:
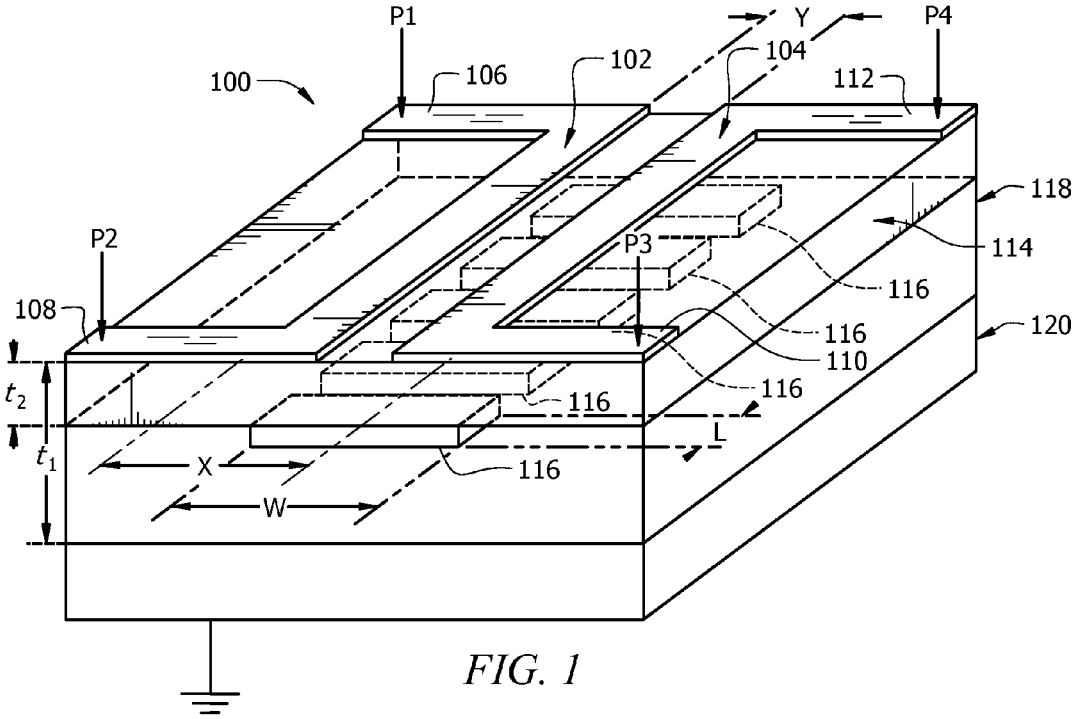
FIG. 1 is a schematic diagram of an exemplary miniature quadrature hybrid coupler in accordance with an embodiment of the present invention.

An exemplary schematic diagram of a miniature quadrature hybrid coupler 100 according to an embodiment of the present invention is provided in FIG. 1. As illustrated therein, the inventive coupler 100 can include a first transmission line 102 and second transmission line 104, where both transmission lines can be electrically isolated and can have at least a portion disposed along the same direction in order to allow for edge coupling between the lines 102, 104. The transmission lines 102, 104 can be electrically isolated using any type of dielectric materials, including gaseous, liquid, or solid materials. One of ordinary skill in the art will recognize that one method of providing electrically isolated transmission lines for a directional coupler is to form two transmissions lines 102, 104 on a first surface of a dielectric material 114. The transmission lines 102, 104 can be formed in sufficient proximity to allow edge capacitive coupling between the transmission lines 102, 104. Furthermore, to allow consistent coupling over the length of the transmission lines, the transmission lines can be configured to have similar dimensions. However, as previously discussed, fabricating transmission lines using planar fabrication techniques typically requires dimensions and spacing of the transmission lines 102, 104 that typically cannot be reliably mass-produced using conventional techniques. Therefore one aspect of the present invention provides for increasing the spacing of the transmission lines 102, 104. Typically such increased spacing will reduce coupling between the transmission lines 102, 104.

To offset the reduced coupling, another aspect of the present invention provide for forming a set of coupling elements 116, separated from the transmission lines 102, 104 and each other, to offset or increase the coupling between the transmission lines 102, 104. The added coupling elements 116 can reduce tolerance sensitivity for the width and spacing of the transmission lines 102, 104. For example, the improved coupling allows widths and spacing that are obtainable in semiconductor and thin film circuit photolithography.

As shown in FIG. 1, the coupling elements 116 can be formed on a second surface of the dielectric material 114 underneath the transmission lines 102, 104. The dielectric material 114 can be formed on a substrate 118 having one or more dielectric layer 120 formed thereon. The substrate 120 can be grounded to provide a ground plane. The thickness of the dielectric material 114 can typically be any thickness, however the amount of coupling is increased as the thickness of the dielectric material is decreased. More specifically, as the thickness $t_2$ of the dielectric material 114, relative to the distance $t_1$ between the transmission lines 102, 104 and the grounded substrate is decreased, coupling via the coupling elements 116 becomes more dominant. In some embodiments, coupling between the transmission lines 102, 104 and the coupling elements 116 is dominant by configuring the thickness of the dielectric material 114 ($t_2$) to be 1% or less, the distance between the transmission lines and the ground plane ($t_1$). For example, in one embodiment, $t_2$ and $t_1$ are 0.05 um and 100 um, respectively.) In some embodiments, the coupling elements 116 can be formed from a periodic series of identically dimensioned conducting plates positioned on the second surface to follow the path of the transmission lines 102, 104 on the first surface of the substrate 114. The coupling elements 116 can be configured to be of any length (L) and width (W) on the substrate 114. However, the amount of coupling between the transmission lines 102, 104 is reduced whenever the width of the coupling plates falls below a total sum of the width of the transmission lines 102, 104 and the spacing between them (i.e., the total width (X) of the path formed by the transmission lines 102, 104). Therefore, in the various embodiments of the present invention, more effective coupling between the transmission lines 102, 104 can be provided by using coupling elements 116 with larger coupling widths (i.e., $W \geqq X$) and having substantially identical dimensions. Additionally, enhanced coupling can be provided by using coupling elements 116 with lengths L that are only a fraction of the wavelength for the signal. In particular, enhanced coupling is provided when the coupling elements 116 have an electrical length that is at least 1/12 of the wavelength of the input signal.

In the various embodiments of the present invention, it is not required that the coupling elements 116 be identical for proper coupling to occur. Accordingly, aside from variations in fabrication, at least some of the coupling elements can be purposely resized to provide additional functionality. In some embodiments, at least some of the coupling elements can be resized to introduce specific out of band effects such as filtering. For example a conventional couple also operates at odd harmonics of the fundamental operating frequency. Typically, a low-pass filter is required to suppress such reentry. Accordingly, in some embodiments of the invention, by adjusting at least one of coupling elements 116 to have an electrical length corresponding to a quarter wavelength at three times the operating frequency, the odd harmonic reentry can be reduced without the addition of the filter. However, the increased length L can reduce the slow wave effect, and slightly increase the overall size of the coupler.

Together, the transmission lines 102, 104 and the coupling plates 116 can be configured to function as a directional coupler, having four ports P1 (input), P2 (output), P3 (isolated), and P4 (coupled). One of ordinary skill in the art will appreciate that the transmission lines 102, 104 can be further configured to have a total electrical length of $\lambda/4$ to allow the inventive coupler to operate as a quadrature hybrid coupler. That is, the directional coupler can evenly divide the power from the signal received at the input P1 between the output port P2 and the coupled port P4 when the coupler 100 is properly terminated. Furthermore, the phase of signals at the output port P2 and the coupled port P4 112 are separated by 90°. One of ordinary skill in the art will recognize that the physical length of the transmission lines 102, 104 can be greater than $\lambda/4$, depending on the configuration of the transmission lines. For example, as shown in FIG. 1, transmission line contacting portions 106, 108, 110, 112, can be associated with ports P1, P2, P3, and P4, respectively, can extend in a direction different than the path of the transmission lines 102, 104, and the coupling elements 116.

The inclusion of coupling elements 116 in the inventive coupler, results in increased coupling between the transmission lines 102, 104. Furthermore, the additional capacitive coupling provided by the coupling elements 116 can be configured so that the capacitive coupling between the transmission lines 102, 104 is no longer dominated by edge capacitive coupling. Consequently, transmission line spacing (Y) can be increased without affecting overall capacitive coupling between the transmission lines 102, 104. Therefore, by relaxing spacing requirements, conventional processes for forming the transmission lines using planar fabrication techniques, such as for integrated circuits, printed circuit boards, and the like, can be used to reliably fabricate such couplers. Furthermore, because edge capacitive coupling is no longer dominant in the inventive coupler, the size of circuit designs including the inventive coupler can be compressed, as the large spacing typically required in conventional designs between transmission lines in a coupler and adjacent conductors comprising the circuit is no longer required.

In addition to providing the dominant capacitive coupling between the transmission lines, a periodic series of similarly dimensioned coupling elements also decreases the propagation velocity of RF signal in the transmission line. By reducing the propagation velocity in the transmission lines, the resulting wavelength ($\lambda$) of an input RF signal propagating in the transmission lines is reduced, reducing the electrical length ($\lambda/4$) required for generating a coupled RF signal. Consequently, the reduced electrical length can allow the overall size of the inventive coupler to be further reduced for a RF signal at a given operating frequency without significantly affecting operation of the inventive coupler. Accordingly, the inventive coupler can be more easily miniaturized, and in particular, the width and/or height of the transmission lines 102, 104 can be reduced as compared to conventional or Lange couplers. In addition, the quasi-low pass filter nature of the resulting coupler further decreases the propagation velocity and can also allow the electrical length required for the coupled transmission lines to be further reduced.

One of ordinary skill in the art will recognize that the ability to reduce the dimensions required for transmission lines can be beneficial. However, when including the inventive couplers in space-limited circuits the resulting narrower transmission lines can also increase the impedance seen at the ports of the inventive coupler. One solution to this problem would be to adjust the dimensions of the transmission lines in the inventive coupler to compensate for the increased impedance. However, some embodiments of the present invention provide for including additional discrete reactive elements in the inventive coupler to allow proper adjustment of the impedance. In these embodiments, the discrete reactive elements can be connected to the transmission lines in the inventive coupler periodically over their length to adjust the total impedance of the inventive coupler. For example, a coupler, according to one embodiment of the present invention, can include shunt capacitors at each end of the transmission lines and at half of the electrical length ($\lambda/8$) of the transmission lines. These shunt capacitors are described in greater detail in relation to FIGS. 3 and 4. However, the invention is not limited in this regard and other periodic arrangements of discrete reactive components can be used, varying in either in number in the type of discrete reactive elements used for the components.

As a consequence of the inclusion of discrete reactive elements, the inventive coupler can be further reduced in size. For example, shunt capacitors, as described above, decrease the even mode impedance of the structure which in turn deceases coupling. In response, the total number of coupling elements in the inventive coupler can be increased to compensate for this reduced coupling. As a result, as the number of coupling elements is increased, the propagation velocity in the inventive coupler is further reduced, reducing the electrical length (and thus the physical length) of a coupler required for a particular signal. Accordingly, as the number of coupling elements is increased, the total amount of space needed for the coupler can be decreased, as previously described. Therefore, in the various embodiments of the present invention, the final dimensions of the inventive coupler, including the dimensions of the transmission lines, the number and size of the coupling elements, and the size, number, and types of discrete reactive elements can vary according to the impedance requirements and/or the operating frequency needed for the inventive coupler.

Figure 2A:
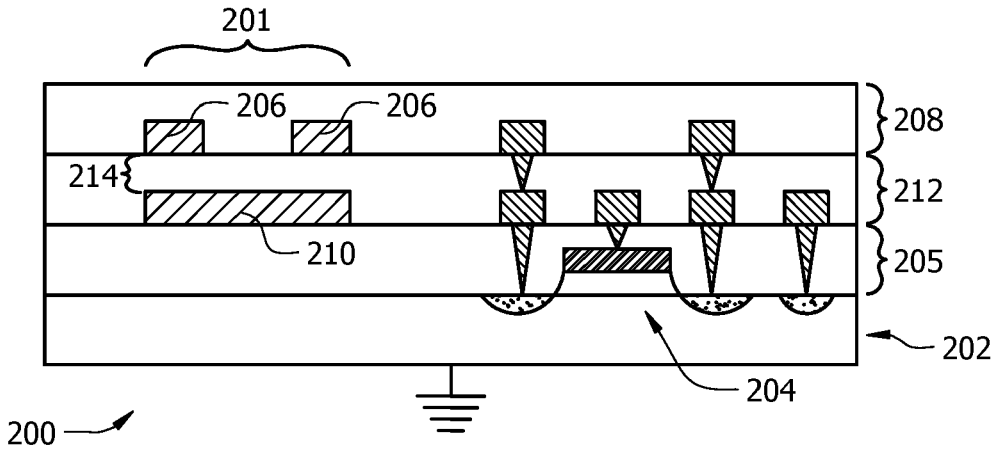
FIGS. 2A-2C show cross-sections of exemplary miniature quadrature hybrid couplers formed in integrated circuits in accordance with the various embodiments of the present invention.
Figure 2B:
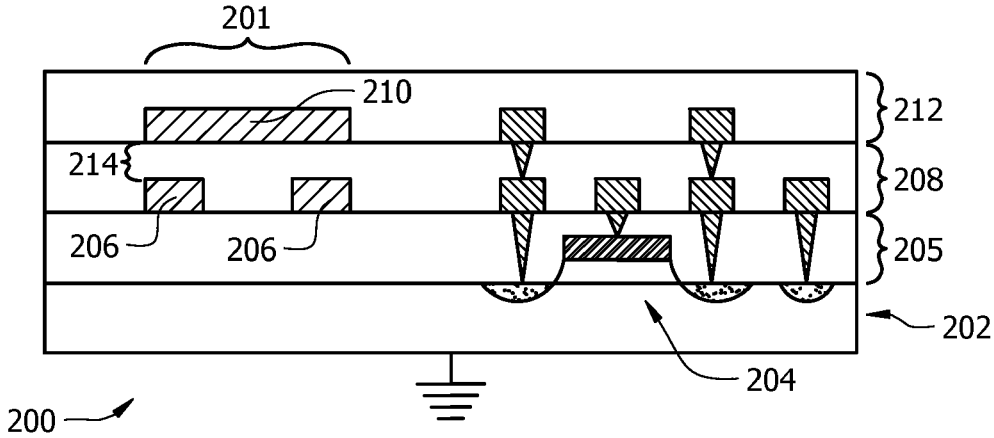
Figure 2C:
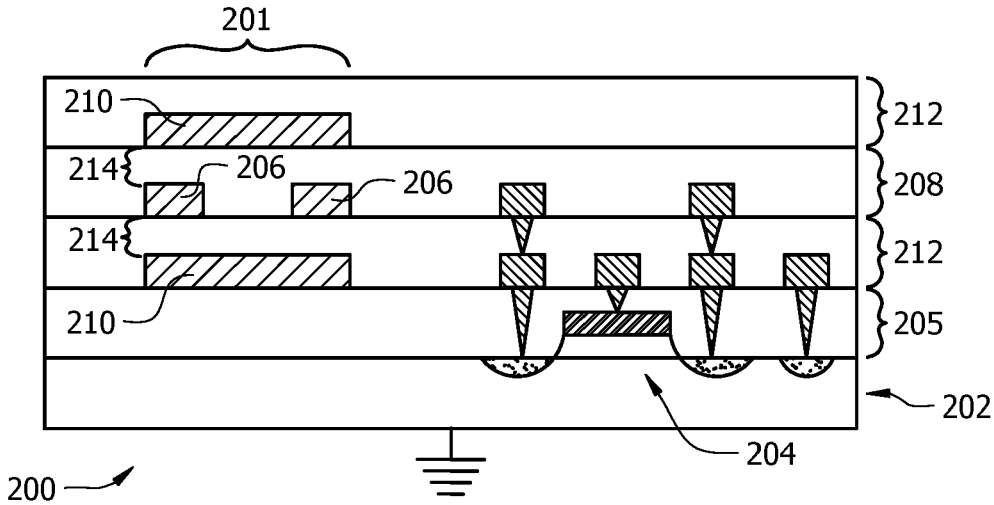

As previously described, transmission lines, the coupling elements, and any other reactive elements for the inventive coupler can be formed on opposing sides of a dielectric layer disposed on a thicker dielectric substrate. However, the invention is not limited in this regard and the inventive coupler can be formed using a variety of other fabrication techniques. In some embodiments, as shown in FIGS. 2*a*-2*c*, integrated circuit fabrication techniques can be used to form the inventive coupler. For example, a coupler 201 can be formed within the metallization layers, 205, 208, 212 of an integrated circuit 200 formed on a substrate having a semiconducting surface 202 and having one or more devices 204 formed in a device layer 205. Similarly, multilayer printed circuit board fabrication techniques can be used to form the coupler 201 in the different layers of the printed circuit board, including transmission lines, coupling elements, and any additional reactive elements. However the invention is not limited to circuits manufactured on integrated circuit semiconducting substrates or on conventional rigid laminate PCB substrates. In other embodiments, the inventive coupler can be manufactured using any other technologies for forming circuits on a substrate. By way of example, not by way of limitation, such techniques can include other laminate substrate PCB technologies, including flexible PCB-based technologies, and ceramic substrate PCB technologies, including thick film multilayer, co-fired (high or low temperature), and thin film technologies.

In embodiments in which the inventive coupler 201 is formed in an integrated circuit 200, the transmission lines 206 can be formed in a first metal layer 208 of the interconnect structure of the integrated circuit 200. The coupling elements 210 can then be formed in a second metal 212 layer of the integrated circuit 200 separated from the transmission lines 206 by one or more dielectric layers 214. In such embodiments, the second metal layer 212, and thus the coupling elements 210, can be formed above the first metal layer 208, below the first metal layer 208, or both, as shown in FIGS. 2*a*, 2*b*, and 2*c*, respectively. However, in embodiments where coupling elements 210 are formed in a metal layer above the first metal layer 208, coupling between the transmission lines 206 is typically reduced as a result of the increased distance between the coupling elements 210 and, for example, the grounded surface of the substrate 202 of the integrated circuit 200. Accordingly, the size of the coupling elements 210 in the inventive coupler 201 can be increased to improve coupling between the transmission lines 206, 206, based on a position of a ground plane or terminal. Therefore, in the various embodiments of the present invention having the coupling elements 210 formed above and below the transmission lines 206, 206, the size and periodicity of the coupling elements 210 can vary, depending on the amount of resulting coupling and the location of a ground plane or terminal.

Figure 3:
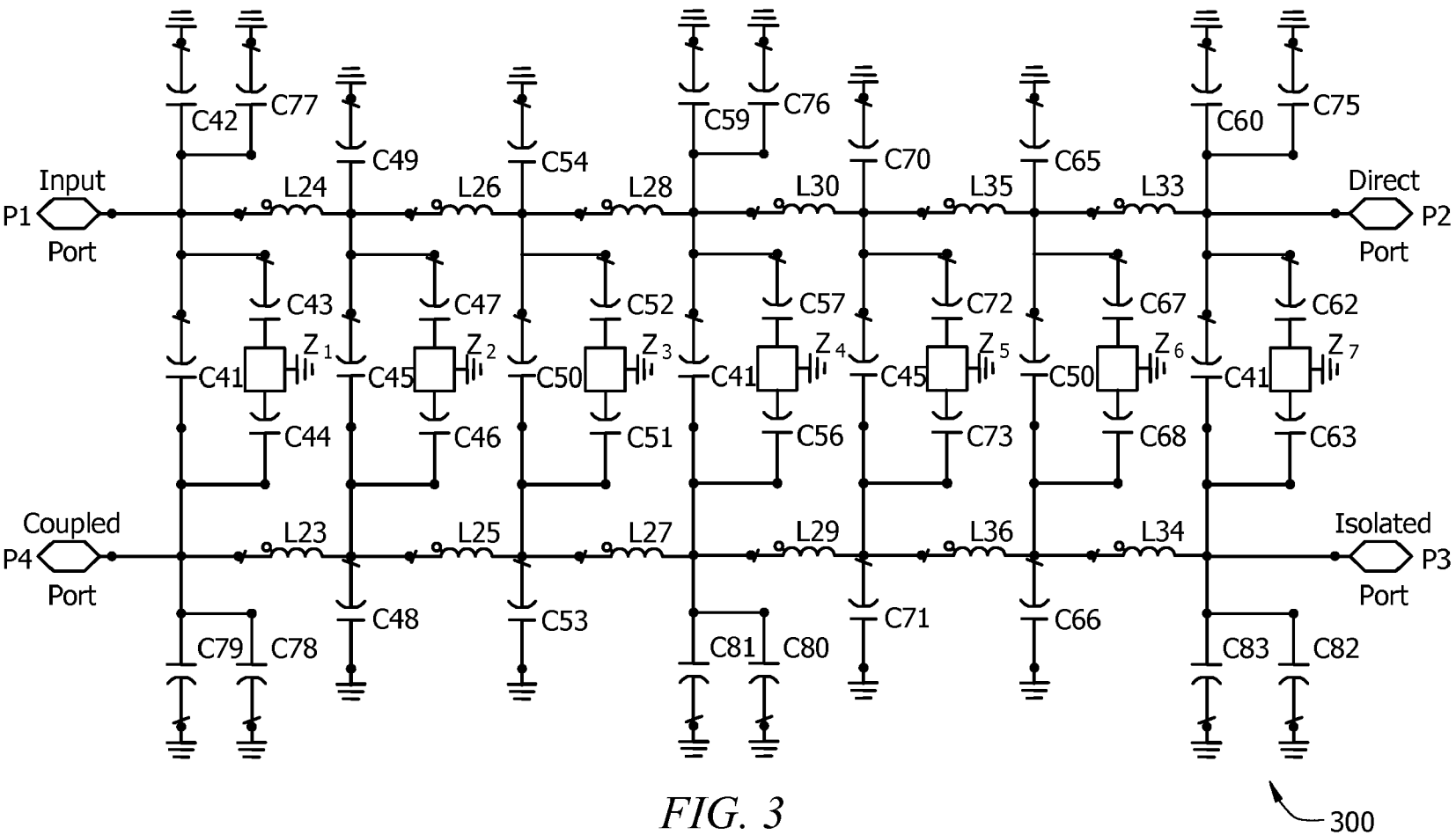
FIG. 3 is an exemplary circuit diagram for a miniature quadrature hybrid coupler in accordance with an embodiment of the present invention.

An exemplary circuit diagram 300 of a coupler according to the various embodiments of the present invention is shown in FIG. 3. Note that circuit diagram 300 includes the contribution of coupling plates and shunt capacitors. In particular, circuit diagram 300 represents a coupler including seven (7) periodically arranged coupling elements and six (6) shunt capacitors placed at the ends and center of the transmission lines at points of the transmission lines that correspond to half of the electrical length. Although the coupler represented in FIG. 3 is shown only to have seven nodes on each transmission line, representative of the total number of coupling elements, one of ordinary skill in the art will understand that circuit diagram 300 is a only exemplary representation of a coupler according to the various embodiments of the invention and that some elements in circuit diagram 300 have simplified for descriptive purposes.

In circuit diagram 300, the first and second transmission lines are represented by the inductors (L24, L26, L28, L30, L35, and L33) connected in series between ports P1 (input port) and P2 (direct or output port) and the inductors (L23, L25, L27, L29, L36, and L34) connected in series between ports P4 (coupled port) and P3 (isolated port), respectively. In addition, the edge coupling component between the first and second transmission lines is represented in circuit diagram 300 by the capacitor elements (C41, C45, C50, C55, C74, C69, and C64) coupling adjacent nodes of the first and second transmission lines. That is, inductor L24 in the first transmission line and inductor L23 in the second transmission line are considered adjacent, as they are associated with the same portion of the length of the transmission lines. Accordingly, the capacitive edge coupling between these adjacent portions is represented by capacitors C41 and C45 connecting the first and second nodes of inductors L24 and L23, respectively. Edge capacitive coupling along the remaining length of the transmission lines is similarly represented in FIG. 3.

In addition to edge capacitive coupling, the transmission lines in the inventive coupler can also have an additional capacitive component resulting from a grounding element, plane, or terminal in proximity to the transmission lines. For example, for transmission lines formed in a metal layer of an integrated circuit, the transmission lines can also be capacitively coupled to a grounded substrate or other ground plane in the integrated circuit over the entire length of the transmission lines. Accordingly, the capacitive ground coupling for the first transmission line is represented in circuit diagram 300 by a first group of capacitor elements (C42, C49, C54, C59, C70, C65, and C60) coupling the nodes of adjacent inductors in the first transmission line to ground. Similarly, the capacitive ground coupling for the second transmission line can be represented in circuit diagram 300 by a second group of capacitor elements (C79, C48, C53, C81, C71, C66, and C83) coupling the nodes of adjacent inductors in the second transmission line to ground. In embodiments where the dimensions of the first and second transmission lines, the spacing therebetween, and the dielectric materials and thickness being used are the same over the length of the transmission lines, the values for the inductors and capacitor elements for the transmission lines are identical. However, one of ordinary skill in the art will recognize that in practice, the actual values for the various elements in the inventive coupler will vary due to process bias and that the operation of the inventive coupler is not significantly affected by such variations.

As previously discussed, edge capacitive coupling is only a minor coupling effect in the inventive coupler and capacitive coupling in the inventive coupler is dominated by other effects. The first of these dominant effects is represented by the capacitive coupling component between the transmission lines due to the coupling elements, as previously described. This capacitive coupling is represented in circuit diagram 300 by the capacitor elements connecting adjacent nodes of the transmission lines to reactive elements $Z_1$-$Z_7$, representing the contribution of coupling elements in the inventive coupler. That is, for each coupling element in the coupler, two additional capacitor elements result, a first capacitor element between the coupling element and the first transmission line and a second capacitor element between the coupling element and the second transmission line. For example, capacitor element C43 connects the input port node P1 in the first transmission line (i.e., the beginning of the transmission lines) to reactive network $Z_1$ associated with a first coupling element in the coupler and capacitor element C44 connects the adjacent coupled port P4 in the second transmission line to reactive network $Z_1$ as well, capacitively coupling the first and second transmission lines to each other through $Z_1$. Similarly, capacitor elements C46, C47, C51, C52, C56, C57, C73, C72, C68, C67, C63, and C62 show the capacitive coupling between the first and second transmission lines via reactive networks $Z_2$-$Z_7$, as shown in FIG. 3.

However, even though the transmission line coupling is dominated by coupling via the coupling elements, coupling to the ground plane can still be significant. In FIG. 3, as previously described, Z1-Z7 represent the small length of conductor in the coupling elements and the capacitance of the coupling elements to the ground plane. Although the length can be considered negligible, as it only represents the gap between the transmission lines, the capacitance to the ground plane can be significant in the aggregate, as the number of coupling elements is increased. Accordingly, the contribution of coupling between the coupling elements and the ground plane can be significant and can be considered in design of the inventive coupler.

The second of the dominant capacitive coupling effects is represented by additional discrete reactive elements used for adjusting the impedance of the coupler. For example, circuit diagram 300 also includes the contribution of shunt capacitors connected to the transmission lines. In particular, the circuit diagram 300 represents an exemplary coupler including shunt capacitors coupled to the ends of the transmission lines and to a point in the transmission lines corresponding to half of the electrical length ($\lambda/8$). Accordingly, the capacitive contribution from the shunt capacitors connected to the ends of the transmission lines is represented in circuit diagram 300 by capacitor elements C77, C75, C82, and C78 coupled to four ports of the coupler, P1, P2, P3, and P4, respectively. Similarly, the capacitive contribution from the shunt capacitors connected to the point corresponding to half of the electric length ($\lambda/8$) of the transmission lines is represented in circuit diagram 300 by capacitor elements C76 and C80 coupled to the first and second transmission lines, respectively.

As previously discussed, coupling in the inventive coupler is dominated by capacitive coupling between the coupling elements and the transmission lines and any discrete reactive elements coupled to the transmission lines. Accordingly, as the requirement to isolate the transmission lines from each other and other conductors is relaxed, greater flexibility is provided in how the inventive coupler can be implemented in a circuit design layout. In particular, because capacitive edge coupling from adjacent conductors in a circuit portion no longer significantly affects operation of the inventive coupler, known space-saving layout designs can be use to implement the inventive coupler. For example, and not by limitation, portions of the transmission lines can be configured to follow serpentine paths, rectangular spiral paths, or circular spiral paths. Additionally, the path for the inventive coupler can be essentially any meandering path between other circuit elements to decrease the total area required for an integrated circuit.

Figure 4A:
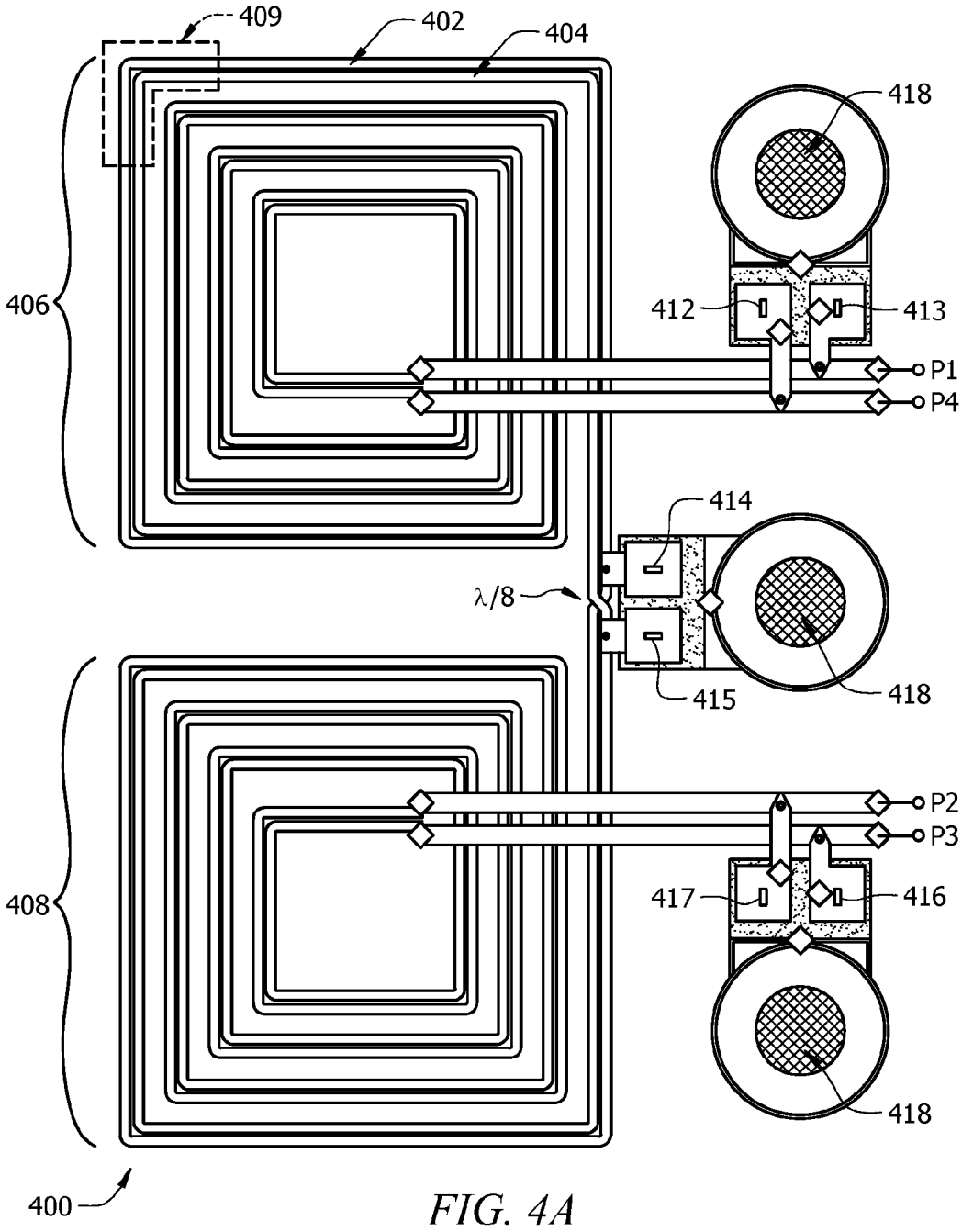
FIG. 4A is an exemplary layout of a miniature quadrature hybrid coupler in accordance with and embodiment of the present invention.

FIG. 4A shows an integrated circuit layout 400 having transmission lines implemented using a known spacing savings design, a rectangular or square spiral. In particular, the layout 400 includes two transmission lines 402, 404 of the required electrical length ($1=\lambda/4$) are arranged in two spirals 406, 408, each including approximately half of the electrical length ($l_{spira}=\lambda/8$). As shown by the enlargement in FIG. 4B of area 409 of the layout in FIG. 4A, the layout 400 can also include a periodic plurality of coupling elements 410. In the exemplary embodiment in FIGS. 4A and 4B, the coupling elements 410 are dimensioned to be 5 μm by 10 μm, and are separated by 5 μm. Furthermore, the transmission lines 402, 404 are 4 μm wide and separated by 2 μm. Although the total width of the transmission lines 402, 404 and the space between (8 μm) is less than the total width of the coupling elements 410, the additional width of the coupling elements 410 in the layout 400 ensures that the resulting width of the coupling elements in the actual device implementing the coupler does not fall below the resulting width of the transmission lines and space between. The dimensions described above are presented by way of example, not limitation, and one of ordinary skill in the art will recognize that the size and spacing of the coupling elements in a particular design can vary according the operation requirements for the coupler and any process bias inherent in the fabrication process.

Figure 4B:
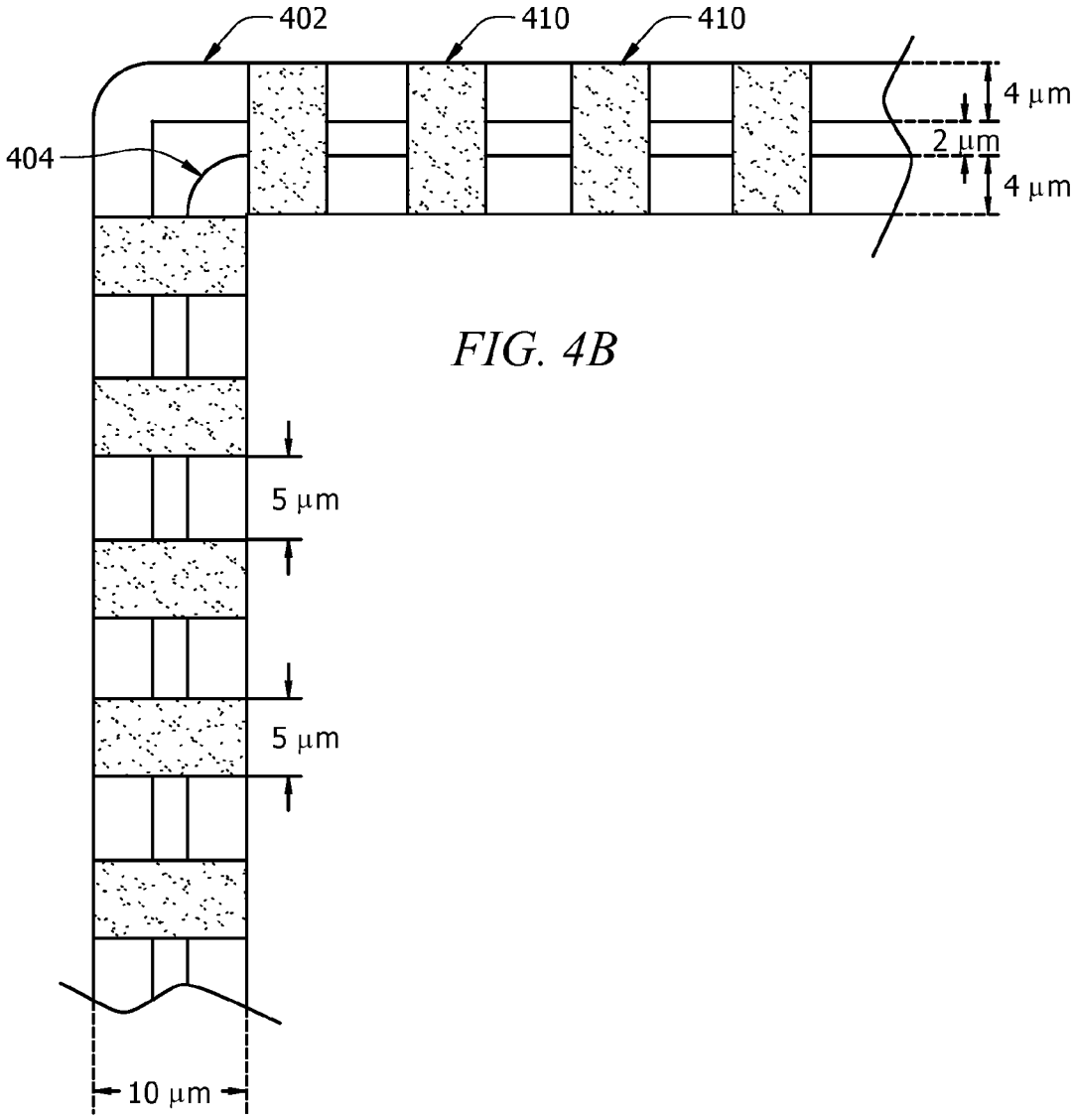
FIG. 4B is an enlarged portion of the exemplary layout in FIG. 4A.
Figure 4C:
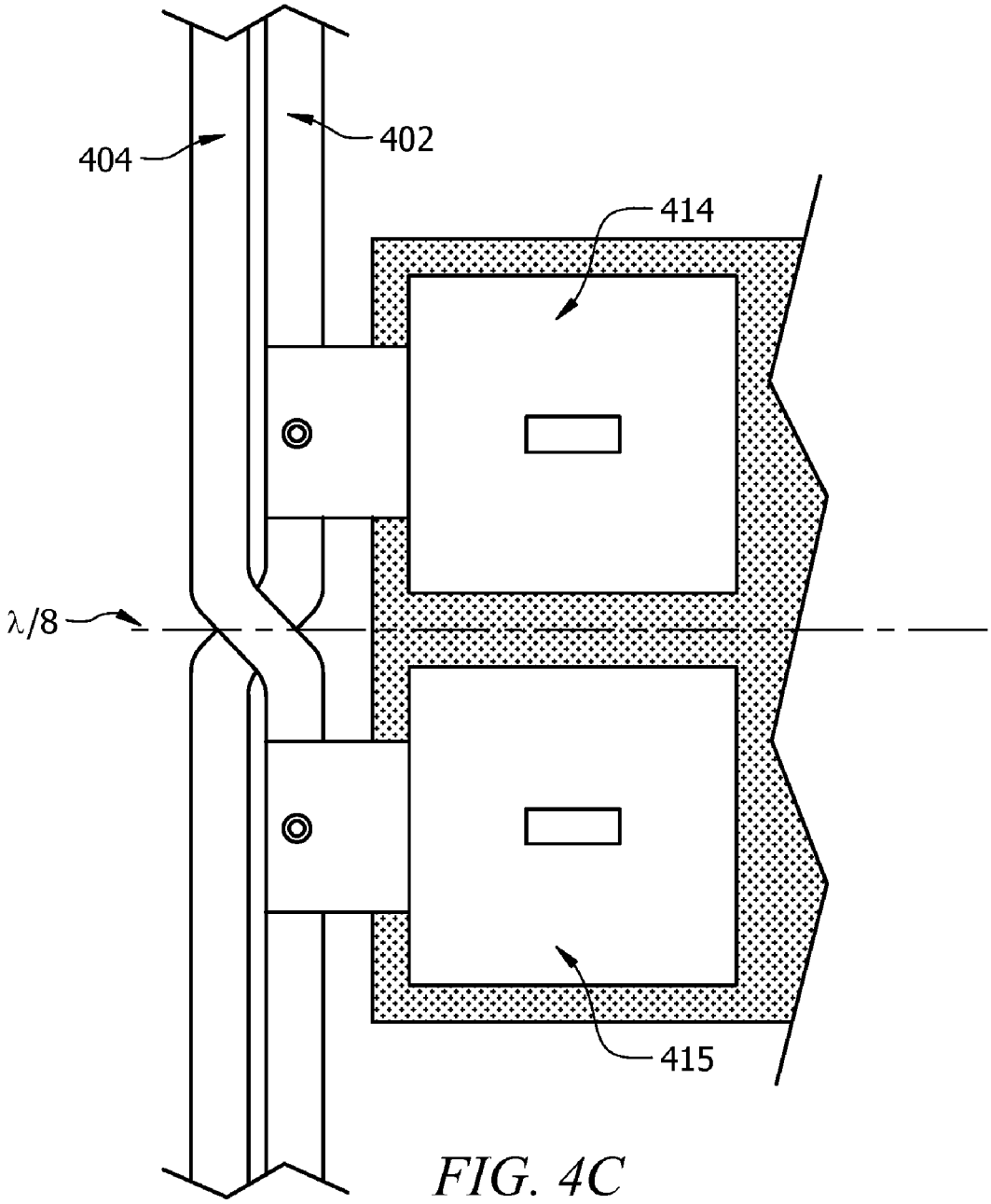
FIG. 4C is another enlarged portion of the exemplary layout in FIG. 4A.

As shown in FIG. 4B, the corners of the spirals 406, 408 in exemplary layout 400 do not include coupling elements 410. However, because capacitive coupling between the transmission lines 402, 404 is dominated by the large number of coupling elements included in layout 400 (≧400 coupling elements), the omission of one or more of the periodic coupling elements for convenience of the design does not significantly affect the overall operation of the inventive coupler. Rather, as previously described, the operation of the inventive coupler is dominated by the overall capacitive coupling proved by the coupling elements and such brief interruptions in the series are insignificant. However, because periodicity of the coupling elements creates the slow wave structure, any disruptions can require longer transmission line lengths and a larger size of the overall structure.

Referring back to FIG. 4A, in addition to spirals 406, 408, the layout 400 can include one or more reactive elements to adjust the impedance of the inventive coupler. In particular, layout 400 includes shunt capacitors 412-417, identically configured and coupled to the transmission lines 402, 404. The shunt capacitors 412-417 can be arranged to in a periodic fashion over the length of the transmission lines 402, 404. In FIG. 4A, the shunt capacitors for the first transmission line 402 are provided by coupling shunt capacitors 413, 415, and 417, respectively, to a first port (P1) of the first transmission line 402, at half of the electrical length of the first transmission line (λ/8) and at a second port (P2) of the first transmission line 402. Similarly, shunt capacitors 412, 414, and 416 can be coupled, respectively to, to a first port (P4) of the second transmission line 404, at half of the electrical length of the second transmission line (λ/8) and at a second port (P3) of the second transmission line 404. A ground contact 418, can also be provided, either individual or collectively to the shunt capacitors 412-317 to couple the capacitors to a ground plane.

The length of the transmission lines 402, 404 can also be equalized to enhance performance of the coupler. For example, as shown in FIG. 4A and the enlargement in FIG. 4C, the transmission lines 402, 404 can cross-over. The cross-over can ensure that any differences in length accumulated by the transmission lines 402, 404 in spirals 406 and 408 are cancelled out. One of ordinary skill in the art will recognize that any number of cross-overs can be used to equalize any resulting paths for transmission lines 402 and 404.

By providing the ability to arrange transmission lines using space-saving designs, a miniature quadrature hybrid coupler for use in integrated circuits, printed circuit boards, and the like, can be more practically included in designs without requiring a significant amount of additional surface area. For example, using the linewidths described above in FIG. 4*b* and implemented in an integrated circuit using the layout in FIG. 4*a*, an inventive coupler can be manufactured having total dimensions of only 400 μm by 300 μm. Comparatively, an equivalent Lange coupler has dimensions of 5600 μm by 100 μm, including allowance for undesired coupling to proximal metallization or circuitry. Therefore, wherein compared to the surface area required for a Lange coupler, including space allowance to avoid adjacent metallization, the present invention can provide a significant reduction in surface area required. For example, for a center operating frequency of 4 GHz on a GaAs substrate, a reduction of 80% is possible using the inventive coupler. However, the resulting size of the inventive coupler will change with operating frequency. Nonetheless, when compared to conventional coupler, the inventive coupler can provide significant space savings for circuits with center operating frequencies at 10 GHz or lower.

The invention described and claimed herein is not to be limited in scope by the preferred embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

I claim:

1. A radio frequency (RF) directional coupler comprising:

a first transmission line element having a first end and a second end;

a second transmission line element having a first end and a second end, said first and said second transmission line elements disposed in a first plane, and at least a portion of said first and said second transmission line elements are adjacent along a path;

a first series of conductive coupling elements disposed along said path in a second plane parallel to the first plane and separated from said first and said second transmission line elements by a first dielectric element, said first and said second plane separated by a pre-determined distance to increase a capacitive coupling between said first and said second transmission line elements.

2. The directional coupler of claim 1, wherein said adjacent portions of said first and said second transmission lines are configured to have a pre-defined electrical length approximately equal to ¼ of a wavelength of an input RF signal.

3. The directional coupler of claim 1, wherein a dimension and spacing of said coupling elements in said first series are configured to reduce a propagation velocity for an input RF signal.

4. The directional coupler of claim 3, wherein said coupling elements in said first series have substantially equal dimensions and spacing.

5. The directional coupler of claim 3, wherein an electrical length of at least one of said coupling elements is at least 1/12 of a wavelength of said input RF signal.

6. The directional coupler of claim 1, further comprising:

a second series of conductive coupling elements disposed along said path in a third plane parallel to the first plane and separated from said first and said second transmission line elements by a second dielectric element, said first and said third plane separated a pre-determined distance to increase a capacitive coupling between said first and said second transmission line elements.

7. The directional coupler of claim 6, wherein at least one among said dimensions and said spacing of the coupling elements in said second series is different as compared to said dimensions and said spacing of the coupling elements in said first series.

8. The directional coupler of claim 1, further comprising one or more discrete reactive elements coupled to said first and said second transmission line elements.

9. The directional coupler of claim 1, wherein said transmission elements are formed in a first layer of a multilevel stack, and wherein said identical coupling elements are formed in a second layer of a multilevel stack, wherein said first dielectric element comprises at least one dielectric layer of said multilevel stack between said first and said second layers.

10. The directional coupler of claim 1, wherein said first and said second transmission line elements have substantially equal dimensions.

11. An integrated circuit comprising:

a substrate having a semiconducting surface;

a plurality of circuit elements formed on the semiconducting surface; and a multilayer metal interconnect structure for connecting said circuit elements, said interconnect structure having:

a first conductive element in a first metal layer of said interconnect structure, said first conductive element having a first end and a second end;

a second conductive element in said first metal layer, said second conductive element having a first end and a second end, and at least a portion of said first and said second conductive elements are adjacent along a path;

a first series of conductive coupling elements disposed along said path in a second metal layer of said interconnect structure, said second metal layer selected to position said first series of coupling elements a pre-determined distance from said first and said second conductive line elements to increase a capacitive coupling between said first and said second conductive elements.

12. The integrated circuit of claim 11, wherein said adjacent portions of said first and said second transmission lines are configured to have a pre-defined electrical length approximately equal to ¼ of a wavelength of an input RF signal.

13. The integrated circuit of claim 11, wherein said second layer is a metal layer of the interconnect structure below said first metal layer.

14. The integrated circuit of claim 12, wherein said coupling elements in said first series have substantially equal dimensions and spacing.

15. The integrated circuit of claim 14, further comprising:

a second series of conductive coupling elements disposed along said path in a third metal layer of said interconnect structure, said third metal layer selected to position said second series of coupling elements a pre-determined distance from said first and said second conductive elements to increase a capacitive coupling between said first and said second conductive elements.

16. The integrated circuit of claim 15, wherein said third metal layer is a metal layer of the interconnect structure above said first metal layer.

17. The integrated circuit of claim 16, wherein at least one among said dimensions and said spacing of the coupling elements in said second series is different as compared to said dimensions and said spacing of the coupling elements in said first series.

18. The integrated circuit of claim 12, wherein an electrical length of at least one of said coupling elements in said first series is at least 1/12 of a wavelength of said input RF signal.

19. The integrated circuit of claim 10, further comprising one or more discrete reactive elements coupled to said first and said second conductive elements, wherein said discrete reactive elements are configured to adjust an impedance of said first and said second conductive elements.

20. The integrated circuit of claim 19, wherein said each of said discrete reactive elements comprise a plurality of substantially similar shunt capacitors coupled to each of said first and said second ends of said first transmission lines, each of said first and said second ends of said second transmission line, and to a point in each of said first and said second transmission lines corresponding to ½ of the electrical length of said first and said second transmission lines.

* * * * *